US006386901B1

(12) United States Patent
Caldwell

(10) Patent No.: US 6,386,901 B1
(45) Date of Patent: May 14, 2002

(54) PIERCING PIN STRUCTURE AND ATTACHMENT FOR HIGHER DENSITY RIBBON CABLE

(75) Inventor: Barry Caldwell, Hesston, KS (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/595,100

(22) Filed: Jun. 16, 2000

(51) Int. Cl.[7] ..... H01R 4/24; H01R 4/26; H01R 11/20

(52) U.S. Cl. ..... 439/425; 439/404

(58) Field of Search ..... 439/404, 405, 439/77, 425

(56) References Cited

U.S. PATENT DOCUMENTS

| | | | | | |
|---|---|---|---|---|---|
| 4,026,625 | A | * | 5/1977 | Roiko et al. | 439/405 |
| 4,410,229 | A | * | 10/1983 | Stephenson | 439/405 |
| 4,909,755 | A | * | 3/1990 | Chen | 439/418 |
| 5,104,336 | A | * | 4/1992 | Hayanaka et al. | 439/404 |
| 5,246,381 | A | * | 9/1993 | Tashiro et al. | 439/395 |
| 5,376,018 | A | * | 12/1994 | Davis et al. | 439/405 |
| 5,971,793 | A | * | 10/1999 | Jochen et al. | 439/405 |
| 6,012,943 | A | * | 1/2000 | Wu | 439/404 |
| 6,077,105 | A | * | 6/2000 | Jochen et al. | 439/405 |
| 6,269,210 | B1 | * | 7/2001 | Yagi et al. | 385/114 |

* cited by examiner

*Primary Examiner*—Tulsidas Patel
*Assistant Examiner*—Hae Moon Hyeon
(74) *Attorney, Agent, or Firm*—Suiter & Associates

(57) ABSTRACT

A connector and pin structure for coupling with a higher density, finer conductor pitch ribbon cable or the like is disclosed. The connector has an array of pins disposed thereon where a beveled tip of the pin allows for the pin to penetrate the insulation sheath of a corresponding conductor, and the pins have a contacting structure that facilitates contact between the pin and the conductor. In one embodiment, such as where the conductor comprises a braided conductor, each pin has a bulge structure that allows for optimal contact between the pin and the conductor. In another embodiment, such as where the conductor comprises a braided conductor or a solid wire conductor, the pin is asymmetrical and has a notch structure that allows for optimal contact between the pin and the conductor. In an embodiment where the ribbon cable has two layers, a first subset of the array of pins contacts the first layer, and a second subset of the array of pins contacts the second layer with the position of the contact structure corresponds to the position of the respective layer of the cable. It is emphasized that this abstract is provided to comply with the rules requiring an abstract that will allow a searcher or other researcher to quickly ascertain the subject matter of the technical disclosure. It is submitted with the understanding that it will not be used to interpret or limit the scope or meaning of the claims. 37 CFR 1.72(*b*).

9 Claims, 7 Drawing Sheets

PIERCING PIN STRUCTURE AND ATTACHMENT FOR HIGHER DENSITY RIBBON CABLE

BACKGROUND

Present Small Computer System Interface (SCSI) ribbon cables are 25 or 50 millimeters center-to-center spacing using standard gauge wire for use with an Insulation Displacement Cable (IDC) compliant press through connectors in accordance with the SCSI Peripheral Interface specification 3 (SPI 3). Current designs do not allow such a cable to be utilized with a Very High Density Cable Interconnect (VHDCI) connector using a ribbon cable without requiring a printed wiring board (PWB) card as a mount for the VHDCI connector. Thus, there lies a need for a SCSI compliant ribbon cable that is capable of utilizing a VHDCI connector. Furthermore, there lies a need for a pin array structure of such a connector that is capable of piercing the insulation of the ribbon cable having a higher conductor density and a tighter wire pitch so that each pin of the array robustly contacts a respective one conductor of the ribbon cable.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to the presently preferred embodiment of the invention, an example of which is illustrated in the accompanying drawings.

Figure 1:
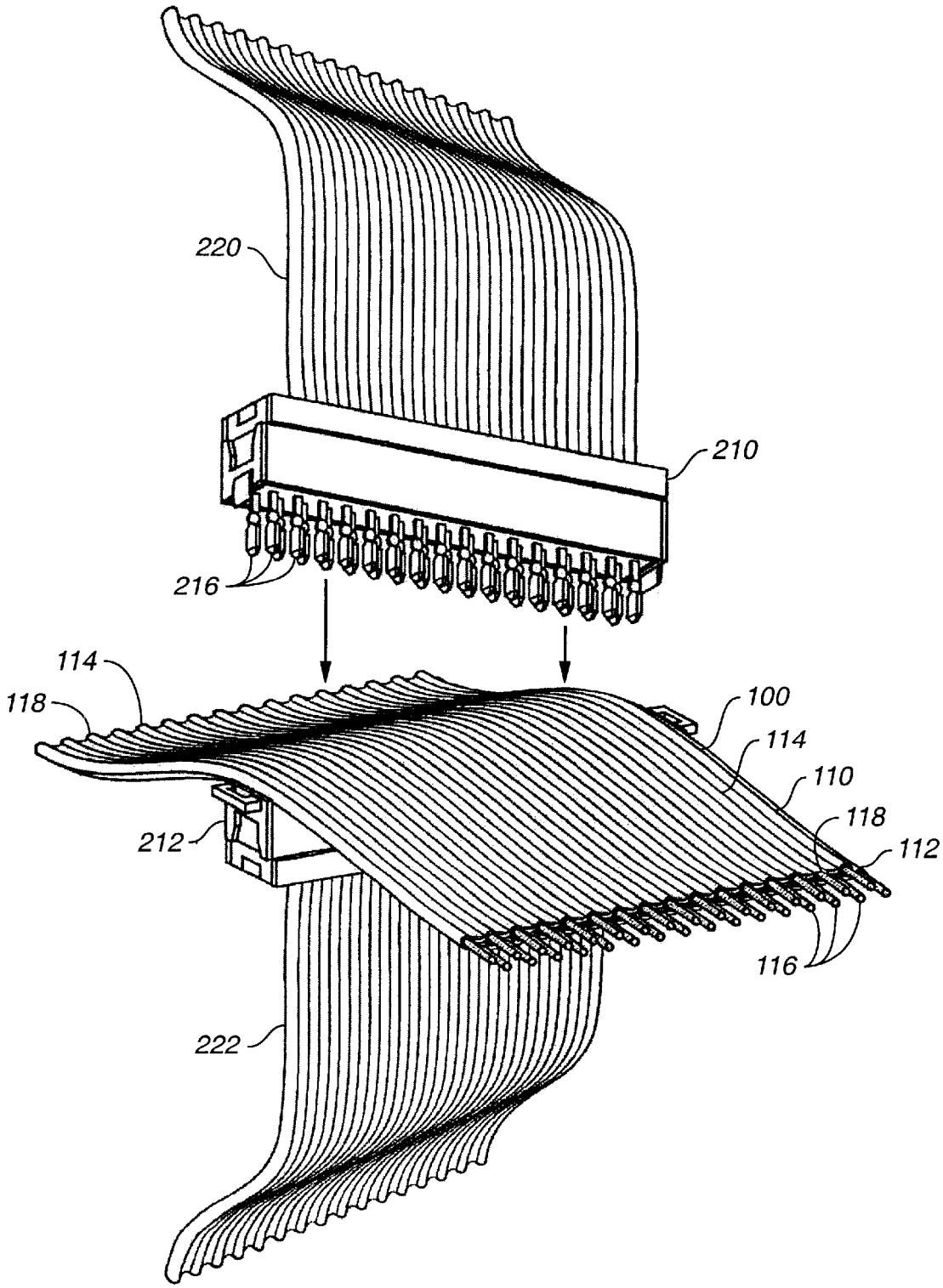
FIG. 1 is a perspective diagram of a ribbon cable and connectors in accordance with the present invention showing a first piercing pin array on the connector.

Referring now to FIG. 1, a ribbon cable configuration of an electrical cable in accordance with the present invention will be discussed. Cable 100 is in one embodiment of the invention a double layer ribbon configuration as shown. Cable 100 includes a first layer 110 and a second layer 112. Each layer 110 and 112 includes at least two or more conductors 116 that are electrically conductive for transmitting electrical signals via cable 100. Each conductor 116 is encapsulated by an insulator 114 that provides electrical insulation of conductors 116 and isolation of one conductor

116 from electrical contact with an adjacent conductor 116. Each of conductors 116 is separated by a predetermined distance provided by spacer 118. The structure of the spacer 118 defining the 118 in one embodiment is a continuation of insulator 114 of two adjacent conductors 116 so that a continuous, generally planar structure is formed. In one embodiment, insulators 114 and spacer 118 structures of both first and second layers 110 and 112 are formed into a single, continuous insulator 114 structure. As shown in FIG. 1, first layer 110 is offset from second layer 112 by an offset distance so that a conductor 116 of one of layers 110 and 112 is generally disposed between two adjacent conductors 116 of the other layer of layers 110 and 112, thereby causing cable 100 to have a double layer ribbon cable configuration where one layer is offset from the other layer. The offset distance in one embodiment is approximately one half of spacer 118. Conductors 116 and insulator 114 in one embodiment are fabricated from a material that provides both the desired respective electrical properties, for example conductivity, dielectric insulation, and so on, and desired respective physical properties such as flexibility such that cable 100 is at least a partially flexible structure. The number of conductors 116 in first and second layers 110 and 112 is dependent upon the number of conductive paths required for the particular application of cable 100. Thus, in one embodiment cable 100 includes in total N conductors 116, with the Nth conductor 122 being disposed in one of said first and second layers 110 and 112, and the (N−1)th conductor 120 being disposed in the other of said first and second layers 110 and 112. One embodiment of the present invention contemplates cable 100 being compliant with a (SCSI) standard, for example SCSI-5. In one embodiment, the total number N of conductors 116 is 68 such that conductor 122 is the 68th conductor and conductor 120 is the 67th conductor. Ribbon cable 100 may be in compliance with any number of standards without providing substantial change to the function of ribbon cable 100.

Connector 210 is shown coupling with first and second layer 110 and 112 of cable 100 so that cable 100 is capable of connecting to a device intended to send or receive signals via cable 100 and which has a like connector or receptacle capable of mating with connector 210 such that electrical and physical coupling between cable 100 and the device is provided. Connector 210 generally comprises a bottom 214 and an offside pressure plate 212 that is capable of mating with bottom 214. Bottom 214 includes an array of pins 216 where each pin 216 is intended to couple with a respective one of conductors 116 of cable 100. One of pins 216 penetrates through an insulator 114 of first layer 110 and makes physical and electrical contact with the respective conductor 116 that the insulator 114 encapsulates, without contacting any other conductor 116 of either first layer 110 or second layer 112. Similarly, another pin 216 penetrates through a predetermined distance structure 118 of first layer 110 without contacting any of the conductors 116 of first layer and penetrates through an insulator 114 of second layer 110 and makes physical and electrical contact with the respective conductor 116 of second layer 112 without contacting any other conductor of second layer 112. In such a configuration, only one pin 216 in the array of pins of bottom 214 contacts a respective one of conductors 116 of cable 100, one pin 216 for each respective conductor 116. It should be noted that in some embodiments of cable 100, the number of pins 216 need not equal the number of conductors 116, for example cable 100 may include 68 conductors 116 but connector 210 may include only 48 pins, depending upon the particular desired configuration of cable 100 and without providing substantial change to the function of cable 100. Pressure plate 212 includes an array of receptacles 218 corresponding to the array of pins 216 of bottom 214 such that pins 216 insert into a respective receptacle 218 to secure pins 216, for example to retain and to prevent lateral movement of pins 216. Thus, connector 210 couples with cable 100 by bringing bottom 214 together with pressure plate 212 thereby causing pins 216 to penetrate corresponding insulators 114 and contact a respective conductor 116 of first layer 110 or second layer 112. In one embodiment, connector 210 is compliant with a Very High Density Cable Interconnect (VHDCI) standard, and is an (IDC) type connector. In one embodiment, connector 214 is a VHDCI compliant connector that provides 0.8 millimeter spacing and 68 pins 216 and respective contacts and is suitable for use with SCSI-5 compliant cable such that cable 100 is so compliant. As such, cable 100 is compatible with an Ultra-Wide SCSI standard and is suitable for utilization with Redundant Array of Independent Disks (RAID) type controllers. By using a double layer offset ribbon cable, the center-to-center spacing can be reduced to a range such that a SCSI VHDCI connector 210 can be constructed that can mount onto cable 100 at either end of cable 100 or in the middle at a location disposed between either end. By providing a double layer, offset ribbon cable, the center-to-center spacing of cable 100 is thereby capable of being reduced by approximately one-half that of a single layer ribbon cable, and the IDS pitch process of VHDCI connector 210 is thereby capable of being maintained at a lower size to match a 0.8 millimeter pitch in such a connector 210. In addition, cable 100 is capable of being manufactured using current technologies with only slight modification to present tooling. The double layer offset ribbon construction of cable 100 a reduced with center to center spacing allows for an IDC or "vampire" type piercing between first and second layers 110 and 112 of insulation 114 enclosed wire strand conductors 116.

Figure 2:
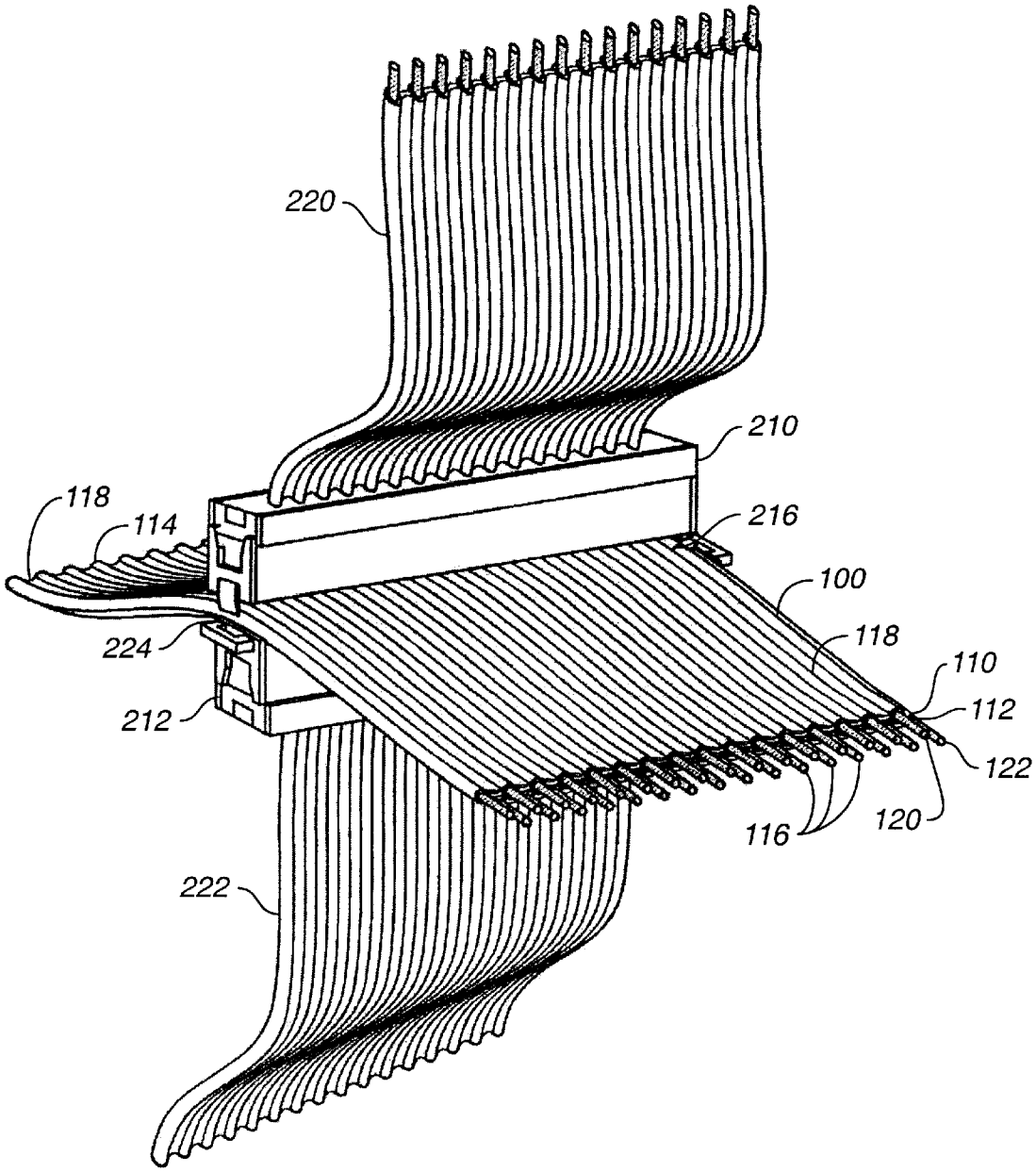
FIG. 2 is a perspective diagram of the ribbon cable and connectors as shown in FIG. 1 further showing the piercing of the pin array of the connector through the ribbon cable.

Referring now to FIG. 2, the ribbon cable and connector attachment as shown in FIG. 1 will be discussed wherein the piercing of the pins 116 through cable 100 is shown. As bottom 214 is brought together with pressure plate 212, each pin 216 of connector 212 aligns with a respective one conductor 116 of cable 100. As pressure is applied between pressure plate 212 and bottom 214, pins 216 pierce through insulation 114 and come into contact with a respective conductor 116 so that each conductor is electrically coupled to one pin 216. As a result, connector 210 is able to provide an electrical connection between cable 100 and an additional electrical device. As shown in FIGS. 1–4, either one of bottom 214 or pressure plate 212 may contain an additional cable 220 and 220 to provide a continuation of conductors 116 of cable 100 such that connector 210 provides a junction point 224 on cable 100. In an alternative embodiment, connector 210 may be a terminal connector that couples with a corresponding connector on an electronic device so that cable 100 may couple with the electronic device. In such an embodiment, additional cables 220 and 222 may be not present, and connector 210 instead includes an array of contacts (not shown) that are coupled with pins 216 and that mate with a corresponding array of contacts on the electronic device. Junction point 224 may be placed at any point along cable 100 without providing substantial change to the function of the present invention. Further detail of pins 216, the piercing of pins 216 through insulation 114 of cable 100, and the contacting of pins 216 with conductors 116 will be discussed with respect to FIGS. 5 and 6.

Figure 3:
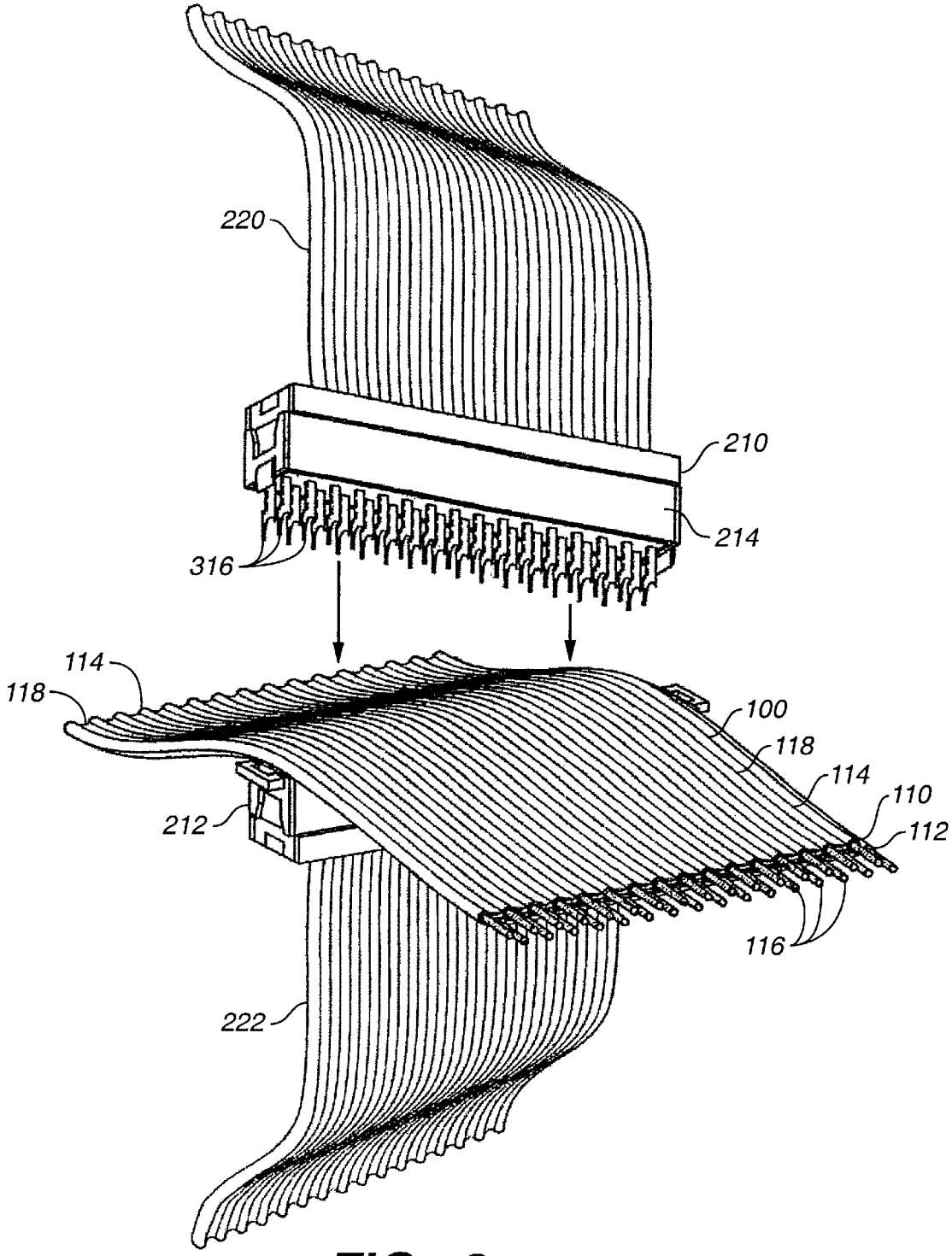
FIG. 3 is a perspective diagram of a ribbon cable and connectors in accordance with the present invention showing a second piercing pin array on the connector.
Figure 4:
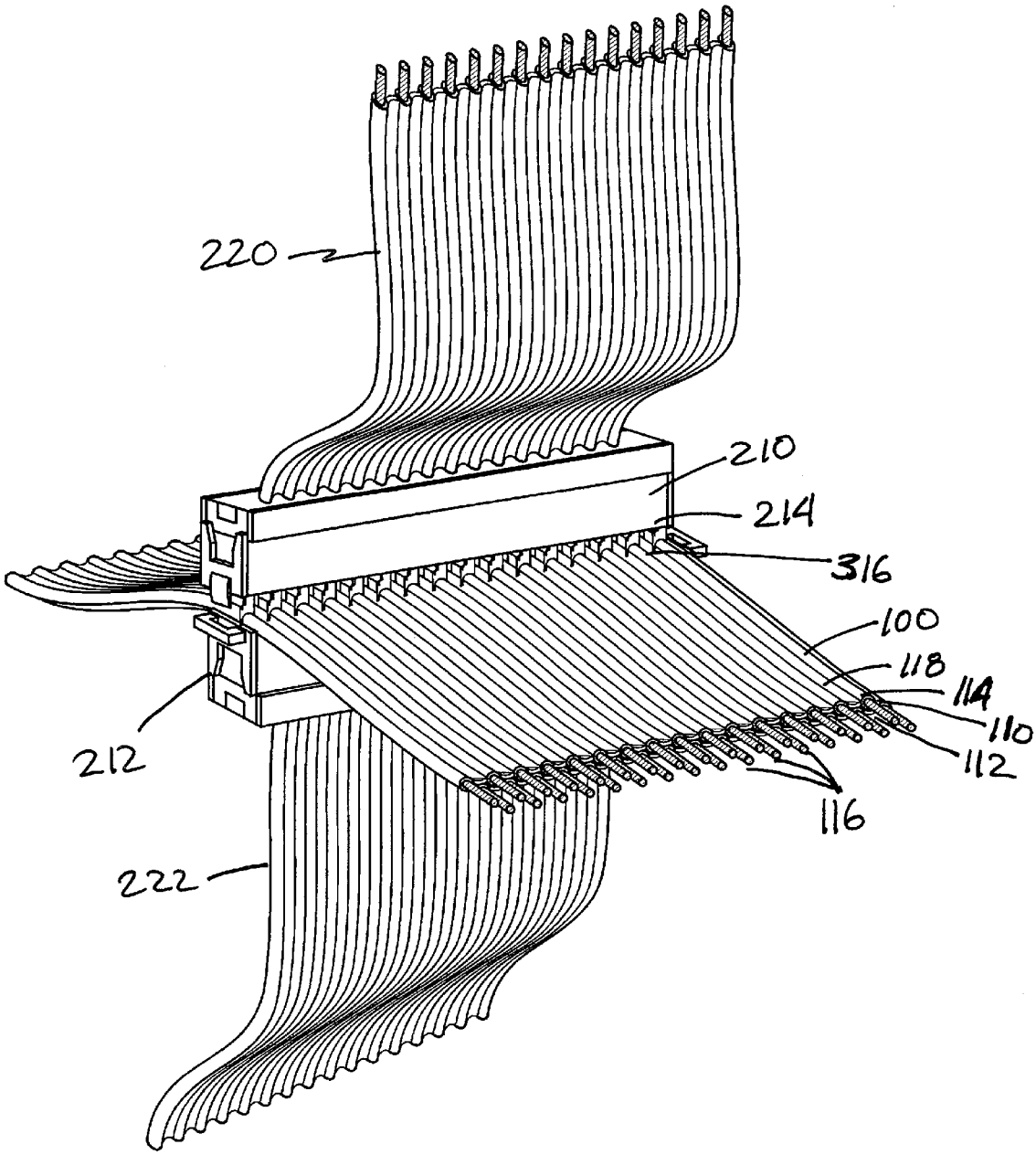
FIG. 4 is a perspective diagram of the ribbon cable and connectors as shown in FIG. 3 further showing the piercing of the pin array of the connector through the ribbon cable.

FIG. 3 is a perspective diagram of the ribbon cable and connector substantially as shown in FIG. 1. In FIG. 3, connector 210 has a second array of pins 316 where pins 316 have an asymmetrical structure including a piercing tip 516 and notch 514 for piercing insulation 114 of cable 100 and for contacting with conductors 116. FIG. 4 shows the piercing of ribbon cable 100 with the pins of connector 210 substantially as shown in FIG. 2 where connector 210 includes the second array of pins 316. Further detail of pins 316, the piercing of pins 316 through insulation 114 of cable 100, and the contacting of pins 316 with conductors 116 will be discussed with respect to FIGS. 5 and 6.

Figure 5:
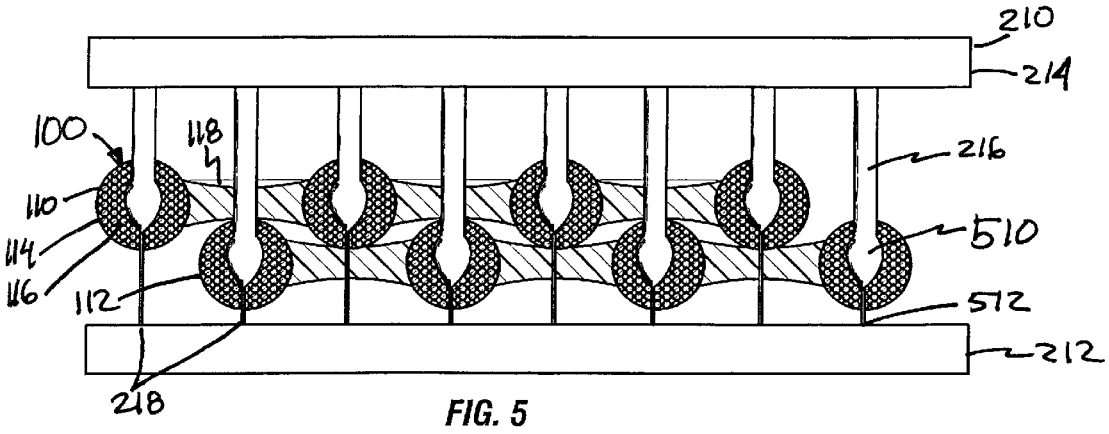
FIGS. 5 and 6 are end elevation views of the ribbon cable and connectors shown FIGS. 2 and 4 showing the piercing of the first and second piercing pin arrays piercing the ribbon cable and contacting with the respective conductors of the ribbon cable in accordance with the present invention.
Figure 6:
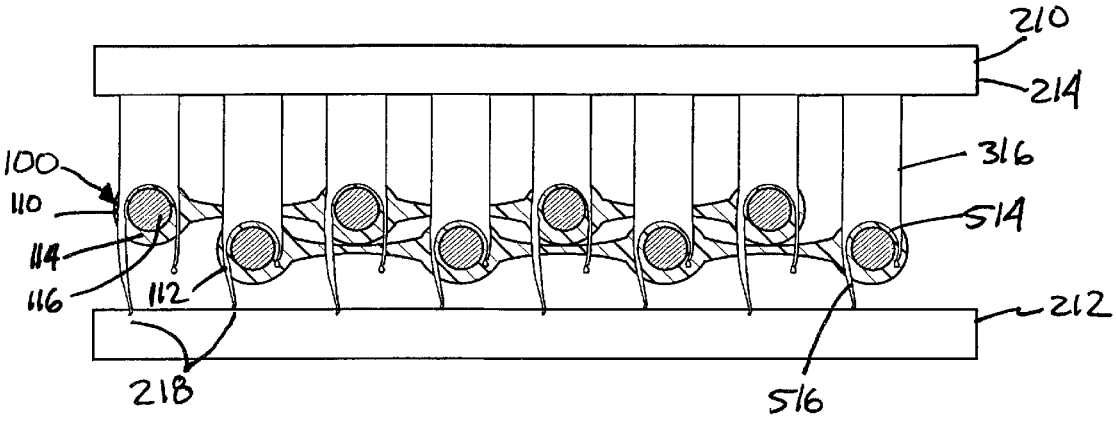
Figure 7:
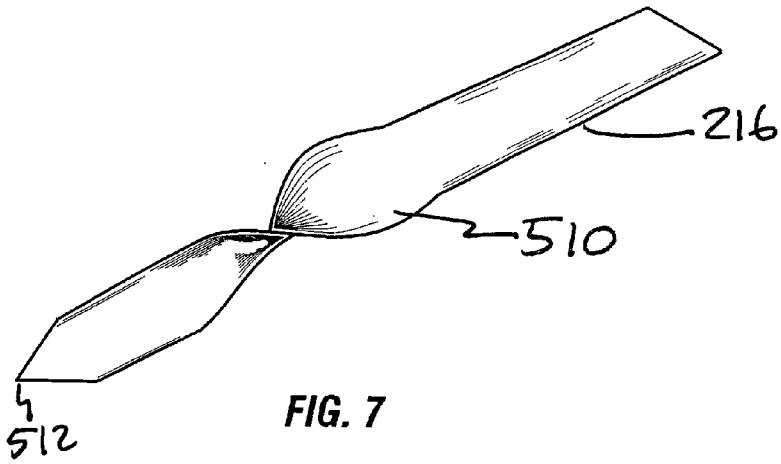
FIGS. 7, 8, and 9 are an isometric, an elevation, and a plan view, respectively, of the pin shown in FIGS. 1, 2, and 5.
Figure 8:
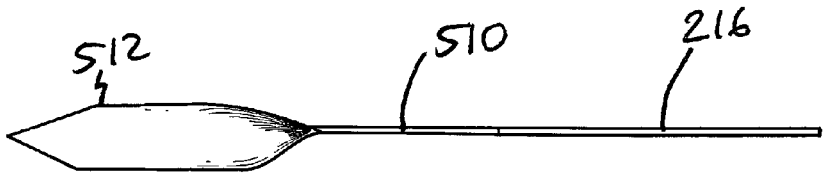
Figure 9:
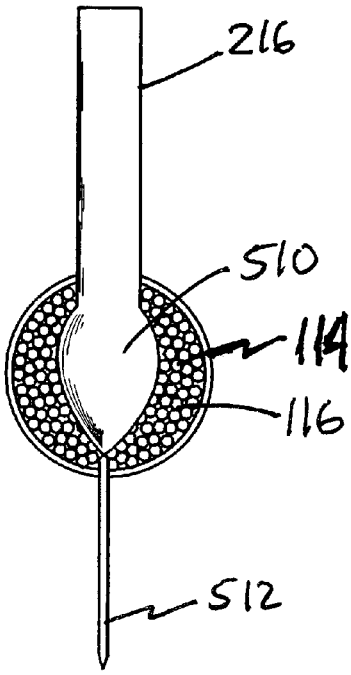

Referring now to FIGS. 5 and 6, and also to FIGS. 7, 8, and 9, end elevation views of the ribbon cable and connectors shown in FIGS. 2 and 4 showing the piercing of the first and second piercing pin arrays piercing the ribbon cable and contacting with the respective conductors of the ribbon cable in accordance with the present invention will be discussed. As shown in FIG. 5 and in FIGS. 7–9, pins 216 have a bulge structure 510 formed on the shaft of each respective pin, and each pin has a beveled tip 512. When bottom plate 214 is brought together with pressure plate 212, beveled tips 512 of pins 216 pierce insulation 114 surrounding conductors 116, and where appropriate beveled tips 512 pierce spacer 118, such that bulges 510 come into contact with a respective conductor 116. Ribbon cable 100 as shown in the embodiment of FIG. 5 includes a first layer 110 of conductors 116 and a second layer 112 of conductors 116. A first subset of the array of pins 216 has bulge 510 of each pin 216 positioned to contact conductors 116 of first layer 110, and a second subset of the array of pins 216 has bulge 510 of each pin positioned to contact conductors 116 of second layer. In the case where pins 216 contact conductors 116 of second layer 112, at least some pins 216 of the second subset of pins 216 penetrate through spacer 118 of first layer 110 to come into contact with second layer 112. As is shown in FIGS. 5 and 6, second layer 112 of conductors 116 is offset from first layer 110 of conductors, so that conductors 116 of one of the first and second layers 110 and 112 are generally disposed between adjacent conductors 116 of the other of the first and second layers 110 and 112, except for some conductors 116 disposed at an end of either of the first and second layers 110 and 112 as shown in FIGS. 5 and 6. Likewise, with respect to FIG. 6, pins 316 provide an alternative structure to pins 216, but function is a substantially similar manner. Pins 316 include an offset tip 516 such that an asymmetrical configuration of pins 316 is provided. Furthermore, pins 316 include a notch 514 formed on the shaft of the pins 316 that is optimally formed for allowing a conductor 116 of cable 100 to nestle within notch 514 when pins 316 pierce insulation 114, or spacer 118 where appropriate, and come into contact with a respective corresponding conductor 116. As the longer tip 516 of pins 316 moves through the layers of cable 100, the tips cut through insulator 114 to allow the tips to spring around conductor 116, which may be either a solid or stranded wire. The function of pins 316 allows conductor 116 to recenter and seat within notch 514. In one embodiment of the invention, tips 516 have chiseled points to facilitate piercing of insulator 114. In a particular embodiment, tips 514 are angled inward towards each other to be within the outer boundary of conductor 116 and provide a spring action as the tips press conductor 116 to the side and then seat conductor 116 within notch 514 such that an electromechanical connection is provided between conductor 116 and pins 316. Pins 216 having bulges 510 may be utilized where conductors 116 comprise braided wire conductors, and pins 316 having notches 514 and tips 516 that cause pins 316 to be asymmetrical may be utilized where conductors 116 comprise braided wire conductors or solid wire conductors. In both FIGS. 5 and 6, pressure plate 212 includes an array of receptacles 218 where each receptacle 218 corresponds to a respective one of pins 216 or 316 for securing pins 216 or 316 when bottom plate 212 and pressure plate 214 are brought together to form a unitary structure of connector 210.

Figure 10A:
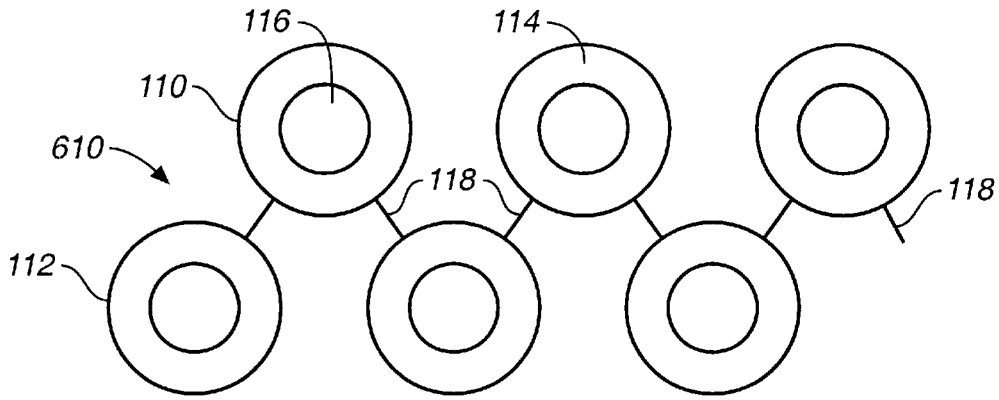
FIGS. 10A, 10B, and 10C are end view diagrams of alternative configurations of the cable shown in FIG. 1 through FIG. 6 in accordance with the present invention.
Figure 10B:
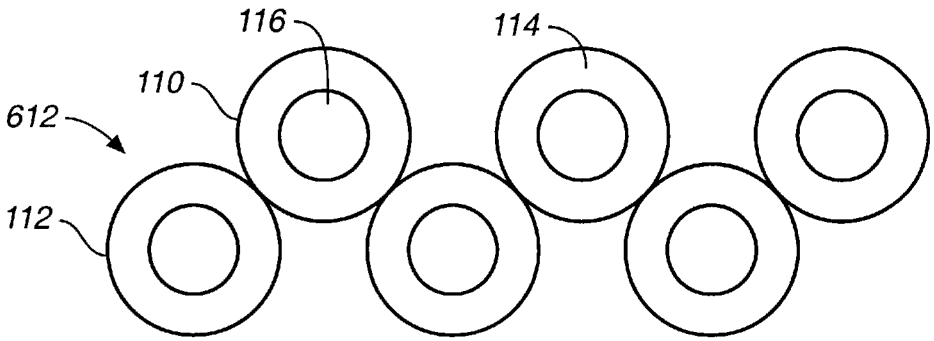
Figure 10C:
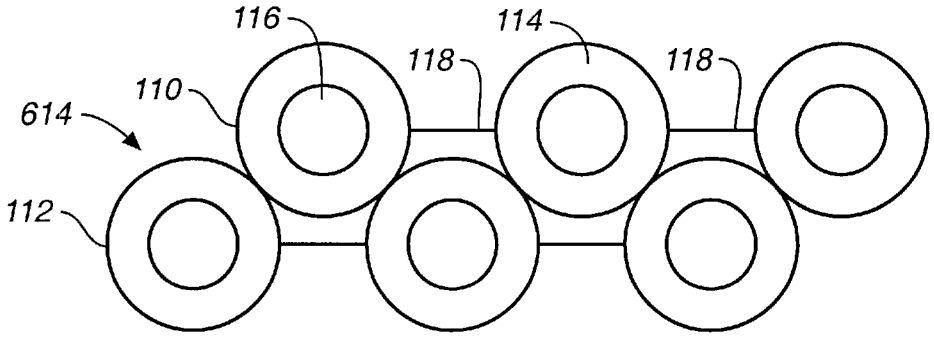

Referring now to FIGS. 10A, 10B, and 10C, alternative configurations of the ribbon cable as shown in FIGS. 1–6 capable of being utilized with the connector and pin structure in accordance with the present invention will be discussed. The configurations of cable 610, 612, and 614 as shown in FIGS. 10A, 10B, and 10C are substantially similar to the configuration of cable 100 as shown in FIGS. 1–6 and couple with pins 216 and 316, and with bottom plate 214 and pressure plate 212 of connector 210 as discussed herein. Cable 610 is a double stack Z-form cable having first and second layers 110 and 112, respectively, that allows cable 610 to stack up tightly while providing flexibility for lateral expansion when pins 216 or 316 of connector 210 are inserted and pierce through insulation 114 sheath and through spacers 118. Spacers 118 couple an insulation 114 sheath of a first layer 110 to adjacent insulation 114 sheaths of the second layer 112, and vice-versa as shown in FIG. 10A. Such a design of cable 610 is capable of being manufactured using extrusion technology. Cable 612 of FIG. 10B has a double stacked form comprising first and second layers 110 and 112, respectively, where insulation 114 sheaths are extruded with very little or no spacers 118. Such a configuration of cable 612 provides a more rigid spacing of conductors 116 where it is desired that the positions of conductors 116 and the overall structure of cable 612 are more strictly controlled. Cable 614 of FIG. 10C has a double stacked form comprising first and second layers 110 and 112, respectively, where spacers 118 of cable 614 are formed such that insulation 114 sheathing provides a center-to-center spacing of conductors 116 to allow pins 216 or 316 to pierce through insulation 114 with a more controlled spacing and structure of conductors 116. Spacers 118 between adjacent insulation 114 sheaths of the same layer, 110 or 112, provide a higher lateral strength to provide a higher center-to-center spacing tolerance between conductors 116.

It is believed that the piercing pin structure and attachment for higher density ribbon cable of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An apparatus, comprising:

an array of pins, each pin of said array of pins having a beveled tip for piercing an insulation layer of a cable, and a bulge formed in a shaft of at east one pin of said array of pins for contacting a conductor of the cable disposed within the insulation layer;

a bottom plate on which said array of pins is disposed; and a pressure plate having an array of receptacles, each pin of said array of pins capable of mating with a respective receptacle when said bottom plate is coupled together with said pressure plate to form a connector such that each receptacle secures the respective pin mated therewith.

2. An apparatus, comprising:

an array of pins, each pin of said array of pins having a beveled tip for piercing an insulation layer of a cable, and a bulge formed thereon for contacting a conductor of the cable disposed within the insulation layer;

a bottom plate on which said array of pins is disposed; and a pressure plate having an array of receptacles, each pin of said array of pins capable of mating with a respective receptacle when said bottom plate is coupled together with said pressure plate to form a connector such that each receptacle secures the respective pin mated therewith.

3. An apparatus as claimed in claim 2, where the cable comprises two layers of conductors, said array of pins being configured such that said bulge of a first subset of said array of pins are disposed at a position along said first subset of pins are capable of contacting the first layer of conductors of the cable, and said bulge of a second subset of said arrays of pins are disposed at a position along said second subset of pins are capable of contacting the second layer of conductors of the cable.

4. An apparatus as claimed in claim 2, where the cable comprises two layers of conductors, the first layer of conductors being offset from the second layer of conductors, said array of pins being configured such that a first subset of said array of pins is positioned to contact the first layer of conductors, and a second subset of said array of pins is positioned to contact the second layer of conductors.

5. An apparatus as claimed in claim 2, where the cable comprises two layers of conductors, the first layer of conductors being offset from the second layer of conductors, said array of pins being configured such that a first subset of said array of pins is positioned to contact the first layer of conductors, and a second subset of said array of pins is positioned to contact the second layer of conductors, the pins of said first subset alternating in position with the pins of said second subset.

6. An apparatus, comprising:

an array of pins, each pin of said array of pins having a longer tip and a shorter tip, said longer tip being beveled for piercing an insulation layer of a cable, each pin of said array of pins having a notch formed thereon for contacting a conductor of the cable disposed within the insulation layer;

a bottom plate on which said array of pins is disposed; and a pressure plate having an array of receptacles, each pin of said array of pins capable of mating with a respective receptacle when said bottom plate is coupled together with said pressure plate to form a connector such that each receptacle secures the respective pin mated therewith.

7. An apparatus as claimed in claim 6, where the cable comprises two layers of conductors, said array of pins being configured such that said notch of a first subset of said array of pins are disposed at a position along said first subset of pins are capable of contacting the first layer of conductors of the cable, and said notch of a second subset of said arrays of pins are disposed at a position along said second subset of pins are capable of contacting the second layer of conductors of the cable.

8. An apparatus as claimed in claim 6, where the cable comprises two layers of conductors, the first layer of conductors being offset from the second layer of conductors, said array of pins being configured such that a first subset of said array of pins is positioned to contact the first layer of conductors, and a second subset of said array of pins is positioned to contact the second layer of conductors.

9. An apparatus as claimed in claim 6, where the cable comprises two layers of conductors, the first layer of conductors being offset from the second layer of conductors, said array of pins being configured such that a first subset of said array of pins is positioned to contact the first layer of conductors, and a second subset of said array of pins is positioned to contact the second layer of conductors, the pins of said first subset alternating in position with the pins of said second subset.

* * * * *